US005399248A

United States Patent [19]

Ettelbrück et al.

[11] Patent Number: 5,399,248

[45] Date of Patent: Mar. 21, 1995

[54] CLAMPING DEVICE FOR GRAVURE PRINTING CYLINDERS TO BE PROCESSED IN AN ELECTROPLATING PLANT

[75] Inventors: Rüdiger Ettelbrück, Aschheim; Klaus Hofmann, Pinzenau, both of Germany

[73] Assignee: Maschinenfabrik Kaspar Walter GmbH & Co. KG, Munich, Germany

[21] Appl. No.: 141,540

[22] Filed: Oct. 27, 1993

[30] Foreign Application Priority Data

Oct. 28, 1992 [DE] Germany ..... 42 36 419.1

[51] Int. Cl.[6] ..... C25D 17/00; C25D 17/06

[52] U.S. Cl. ..... 204/212; 204/286; 204/279; 204/297 R

[58] Field of Search ..... 204/286, 129, 297 R, 204/212, 297 W, 279; 205/137, 143

[56] References Cited

FOREIGN PATENT DOCUMENTS 0082268 6/1983 European Pat. Off. .
666697 8/1988 Switzerland .

OTHER PUBLICATIONS

Von Dr.-Ing. W. Burkhardt, "100 Jahre galvanische und spezielle Prozesse sowie Anlaen für den Fortschritt der Drucktechnik (Teil 2)", Galvanotechnik, Jun. 1992, pp. 1943–1956, Nr. 6, (1992).

*Primary Examiner*—Kathryn Gorgos
*Attorney, Agent, or Firm*—Foley & Lardner

[57] ABSTRACT

The invention is directed to a clamping device for gravure printing cylinders to be processed in an electroplating plant. The clamping device for gravure printing cylinders to be processed in an electroplating plant is equipped, in accordance with a first basic solution, with an interchange holder (1) for a plurality of cone sleeves (2) which have an inside diameter adapted to different spindle ends of various gravure printing cylinders, so that adaptation to a respective identical receiving cone quill (8) is made possible and in the same electroplating plant a plurality of different printing cylinders can be continuously successively processed without the complicated fitting and removal of different collet chucks. According to a second basic solution the interchange holder and the different cone sleeves are not required for the clamping device. Instead, a hardened cone sleeve (21) is used as essential clamping element and clamping is effected with very high contact pressure. Because of the practically gastight connection between the cylinder spindle end and the wall of the hollow cone, very high currents can surprisingly be transmitted.

19 Claims, 2 Drawing Sheets

CLAMPING DEVICE FOR GRAVURE PRINTING CYLINDERS TO BE PROCESSED IN AN ELECTROPLATING PLANT

FIELD OF THE INVENTION

The present invention relates to a clamping device for gravure printing cylinders to be processed in an electroplating plant, which have different spindle diameters, and more particularly to where the current is transmitted from a current supply system to the outer ends of the gravure printing cylinders introduced into the plant.

BACKGROUND OF THE INVENTION

For electroplating treatment, for example, the electroplating of gravure printing cylinders, there are basically two possible ways of transmitting current to the cylinder introduced into the electroplating plant; namely, on the one hand, to the end face of the cylinder body and, on the other hand, through the spindle ends of the cylinder. In the case of current transmission to the spindle end, which is of primary concern here, collet chuck systems are generally used; in which case, adequately large contact transmission areas and a high contact pressure must be ensured because of the high current densities required.

In an electroplating plant for the purpose in question, a number of cylinder types usually have to be processed. The problem then recurs that, when different spindle ends exist, it is not possible for all the cylinders in a printing works to be clamped in the same collet chuck. In the subsequent electroplating processing of cylinders having different spindle ends, it is, therefore, necessary to have available different collet chucks for manual interchange.

SUMMARY OF THE INVENTION

The problem underlying the invention is, therefore, that of providing a clamping device of the kind indicated with which a simple, preferably automatic change is made possible for adaptation to different cylinder spindle ends.

Other objects, advantages and features of the present invention will be more readily appreciated and understood when considered in conjunction with the following detailed description and drawings.

BRIEF DESCRIPTION OF THE DRAWINGS

These and other aspects of the invention are apparent from the following drawings, in which.

Parts or subassemblies corresponding to one another are given the same reference numerals in all the figures.

DESCRIPTION OF THE PREFERRED EMBODIMENTS

Figure 1:
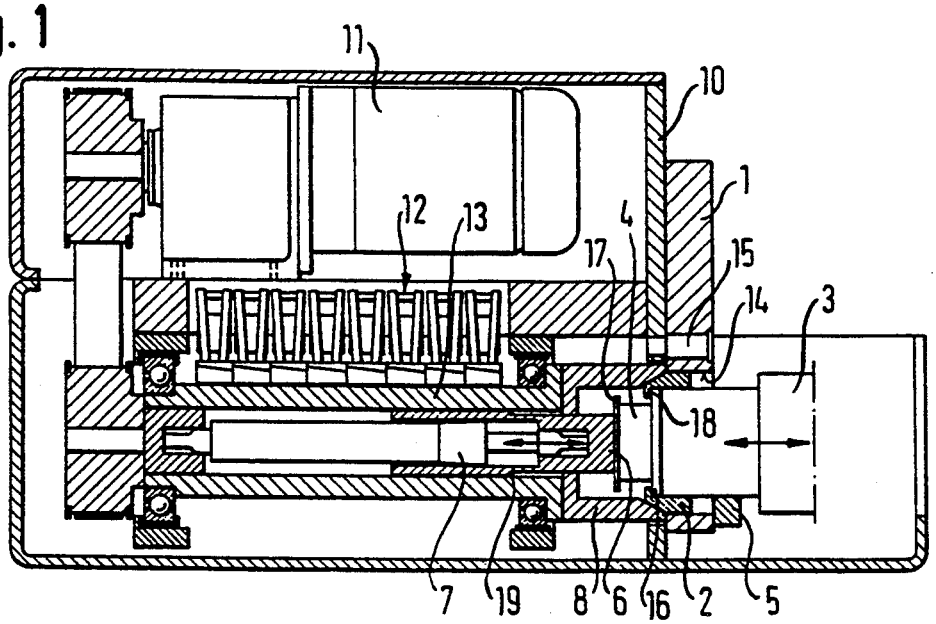
FIG. 1 illustrates the clamping device according to the invention, associated with a printing cylinder electroplating plant (not shown), in accordance with the first embodiment, at the drive end, at which the current transmission is also effected, with the printing cylinder clamped in position.

All the disclosed embodiments can be made using conventional compounds and procedures without undue experimentation. All the disclosed embodiments are useful.

In a clamping device of the type first mentioned above, according to a first embodiment the invention is characterized by:

- a plurality of cone sleeves having an external cone, the same outside diameter and an inside diameter adapted in each case to a determined spindle end diameter of different gravure printing cylinders,
- in each case, an intermediate sliding member mounted in each cone sleeve for axial sliding,
- a movably mounted interchange holder receiving the plurality of cone sleeves, provided with the appertaining intermediate sliding member, in bores adapted to their outside diameter,
- a quill cone sleeve which serves to transmit current to a respective spindle end by way of an appertaining external cone sleeve and whose internal cone is adapted to the respective identical external cone of the cone sleeves, and by
- an ejector device mounted concentrically to the quill cone sleeve for the axial displacement of a respective intermediate sliding member and the respective cone sleeve to the released position inside the appertaining bore in the interchange holder.

According to a second basic solution to the problem posed, in a clamping device for gravure printing cylinders to be processed in an electroplating plant, which have different spindle diameters, wherein the current is transmitted from a current supply system to the outer ends of the gravure printing cylinders introduced into the plant, the invention is characterized by a hardened hollow cone serving as holding and centering element for gravure printing cylinders which are to be clamped at the spindle ends and which have different spindle diameters, and serving as current transmission element between the current supply system and the spindle end of a clamped gravure printing cylinder.

The gravure printing cylinder is clamped axially tinder high pressure by means of hardened hollow cones. In a preferred embodiment, pointed cones having an angle of inclination of less than 60° are used, and in a particularly preferred embodiment, an angle of inclination of approximately in the region of 45°, to the axis of the cone. Through the use of high pressure, both the torque and high currents, (i.e., high current densities), can be transmitted.

The second embodiment of the invention simplifies the problem of adaptation of the clamping device to different spindle ends to a very considerable extent, because with this solution, not only the constructionally expensive collets, which are complicated to manipulate, but also, the interchange holder according to the first embodiment can be dispensed with.

The functional capability of the second embodiment is surprising for the following reason:

A critical point with this kind of clamping by way of a hollow cone is current transition. The literature takes as its starting point transmissible current densities of 2 amperes per square millimeter. This would conflict with a high current transmission through the linear contact in a hollow cone. However, trials have surprisingly shown that with a high contact pressure, for example of about 3000 kp, a practically gastight connection is made between the cone and the spindle end of the cylinder. Far higher current densities can thus be transmitted than was hitherto assumed. In a tested exemplary embodiment of the invention a current of 3000 A was transmitted through a spindle journal of a diameter of 70 mm, with an estimated line width of 0.5 mm of the contact pressure between the hollow cone and the end face edge of the spindle journal, in continuous operation. In a tested plant there can even be transmitted up to 9000 A can with current transmission at both ends. Despite this high current, no noteworthy signs of wear are found on the cone or on the spindle end. Even heat losses are surprisingly extremely low; that is to say, the current transmission region is not excessively heated. This is attributed to the fact that the resistance path between the cone and the spindle end has only a minimal contact resistance.

The current transmission principle according to the second basic embodiment of the invention very substantially simplifies the constructional design of electroplating plants for the purpose indicated, particularly when different types of cylinders have to be processed. In this case, different adapter sleeves can in addition be dispensed with.

Advantageous further developments of and additions to the clamping device according to the invention are the objects of each of the various dependent patent claims.

As the result of the first embodiment according to the invention, the automatic provision of the spindle end of printing cylinders to be treated by electroplating with a sleeve which compensates for differences in diameter and/or length and, therefore, adaptation to the respective identical receiving quill in the same electroplating plant are possible, so that all printing cylinders of a client can be processed in a continuous working process, irrespective of their various individual dimensions.

The invention and advantageous details are explained more fully below with reference to exemplary embodiments and with the aid of the drawings.

EXAMPLES

Specific embodiments of the invention will now be further described by the following, non-limiting examples.

Figure 2:
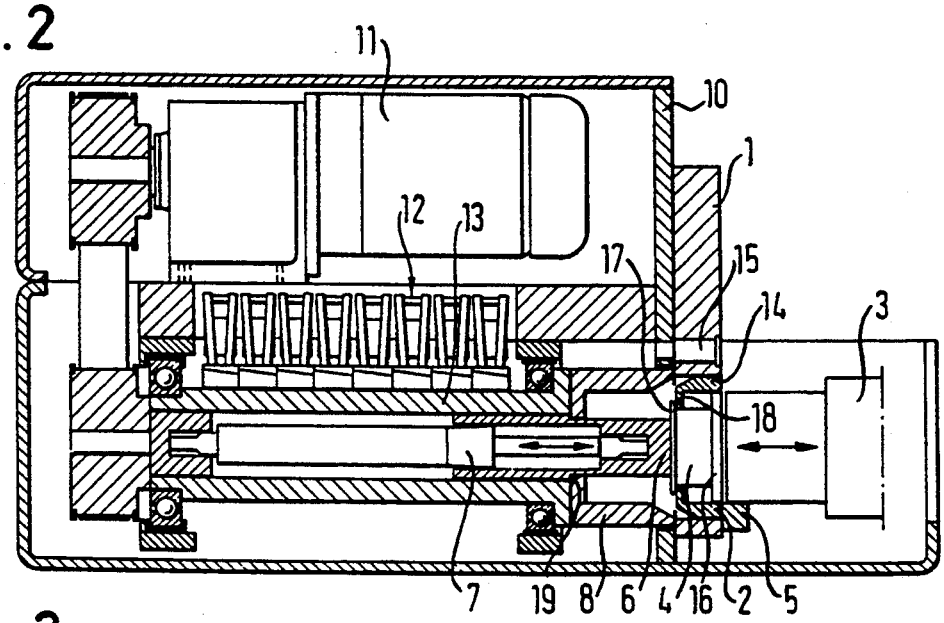
FIG. 2 illustrates the same clamping device at the drive end, but here in the released state, that is to say during a change from one printing cylinder to the next printing cylinder to be processed.

At one end of an electroplating vessel (not shown) for printing cylinders there are cylinder spindle 3 being shown in each case in FIGS. 1 and 2-disposed a drive 11, which is housed in a casing 10 and is of no further interest here since it is known, and a current supply system 12 which transmits the necessary electroplating current to the cylinder spindle end 3 by way of a collector sleeve 13, a quill cone sleeve 8 and a cone sleeve 2 provided with an external cone adapted to the quill cone sleeve. The cone sleeve 2 is held for axial sliding in a bore 14, adapted to the outside diameter of said cone sleeve, in an interchange holder, which in the exemplary embodiment illustrated is an interchange disc 1. The interchange disc 1 can be turned about an axis 15. The inside diameter of the cone sleeve 2 is adapted to the diameter of the spindle end of the printing cylinder; that is to say, the cone sleeve 2 serves as an adapter for different spindle end diameters of the various types of printing cylinders. A rotationally symmetrical intermediate sliding member 4, whose axial length expediently corresponds to that of the cone sleeve 2, is provided at each of its two end faces with flange-like outwardly projecting annular shoulders 16 and 17, respectively. The annular shoulder 16 serves to limit the possible movement path of the intermediate sliding member 4 to the left in FIGS. 1 and 2, by cooperating with an annular stop surface 18 inside the cone sleeve 2. At the other end, the flange-like annular shoulder 17 limits the possible movement path of the intermediate sliding member 4 when the latter is pressed into the cone sleeve 2 by the piston or ram 6 of an ejector device 7 (see FIG. 2). The ejector device 7 is a gas compression spring in the example illustrated.

Figure 3:
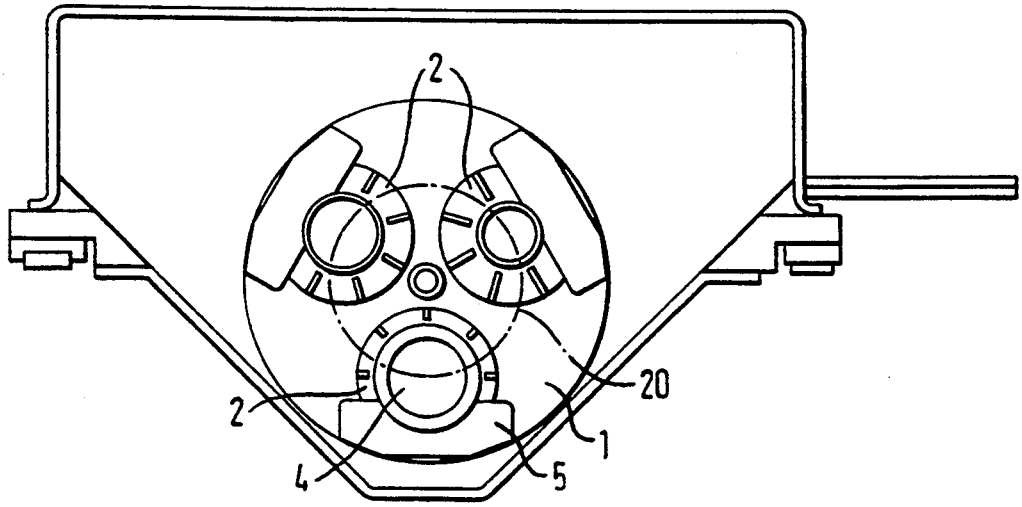
FIG. 3 illustrates an end face plan view of the clamping device of the invention according to FIGS. 1 and 2.

As can be seen in FIG. 3, in the exemplary embodiment illustrated, the interchange holder, that is to say the interchange disc 1, is equipped with three different cone sleeves 2. These different cone sleeves 2 are inserted into annular flange bore 18 disposed with approximately the same angular spacing around the periphery, the respective axes of which bores are disposed on a circle 20 around the axis of rotation 15 of the interchange disc 1.

When the gas compression spring 7 is operated, so that the ram 6 is pushed out to the right for ejection purposes, the intermediate sliding member 4 is first moved to the right, driving the cone sleeve 2 with it by means of its annular shoulder 17 until said cone sleeve, encountering a stop 5, has reached its position of rest inside the appertaining bore 18.

The operating cycle for clamping or changing a printing cylinder, which is to be electroplated, with the aid of the clamping device according to the invention is as follows:

A cone sleeve 2 fitting a determined cylinder end is first prepositioned by turning the interchange disc 1. The cylinder spindle 3 is then engaged and clamped, where the cylinder spindle end pushes the intermediate sliding member 4 in. The intermediate sliding member 4 then carries with it the cone sleeve 2 by means of the flange like external shoulder 16 until the cone sleeve 2 reaches the quill cone sleeve 8, so that the cone sleeve 2 is then pressed onto the cylinder spindle end. The electroplating treatment of the printing cylinder then follows.

On completion of the treatment, the gas compression spring 7 pushes the ram 6 to the right in order to release the clamping, while the cone sleeve 2 is pushed back into the associated receiving bore 18 by means of the intermediate sliding member 4, until it lies against the stop 5. At the same time, the end stroke, that is to say the engagement movement path of the gas compression spring, is limited by an annular shoulder stop 19 in cooperation with the quill cone sleeve 8. The spindle end 3 of the gravure printing cylinder is now completely disengaged; it rests on the stop 5, which at the same time serves as a half-shell-shaped support, and the completely processed printing cylinder can be lifted out of the electroplating plant.

The interchange holder 1 according to the invention for the various cone sleeves 2 need not necessarily be in the form of an interchange disc, although for reasons of space and for automated changing of the cone sleeves this appears at the present time to be the optimum solution. A plate-like interchange holder slidable horizontally or vertically in appropriate guides would for example also be possible.

One exemplary embodiment for the second basic type of a clamping device according to the invention will be explained below with reference to FIGS. 4 and 5. The parts and subassemblies already explained with reference to FIGS. 1 to 3 will not be described again.

Figure 4:
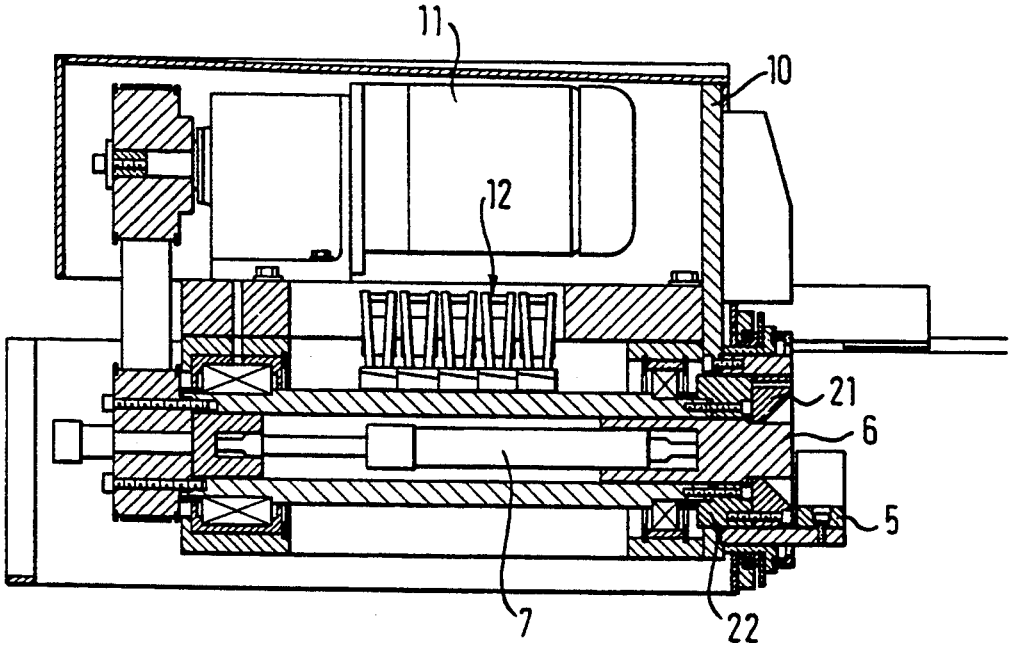
FIG. 4 illustrates the clamping device according to the invention, associated with a printing cylinder electroplating plant (not shown), in accordance with the second embodiment, at the drive end, at which the current transmission is also effected, with the printing cylinder not clamped.
Figure 5:
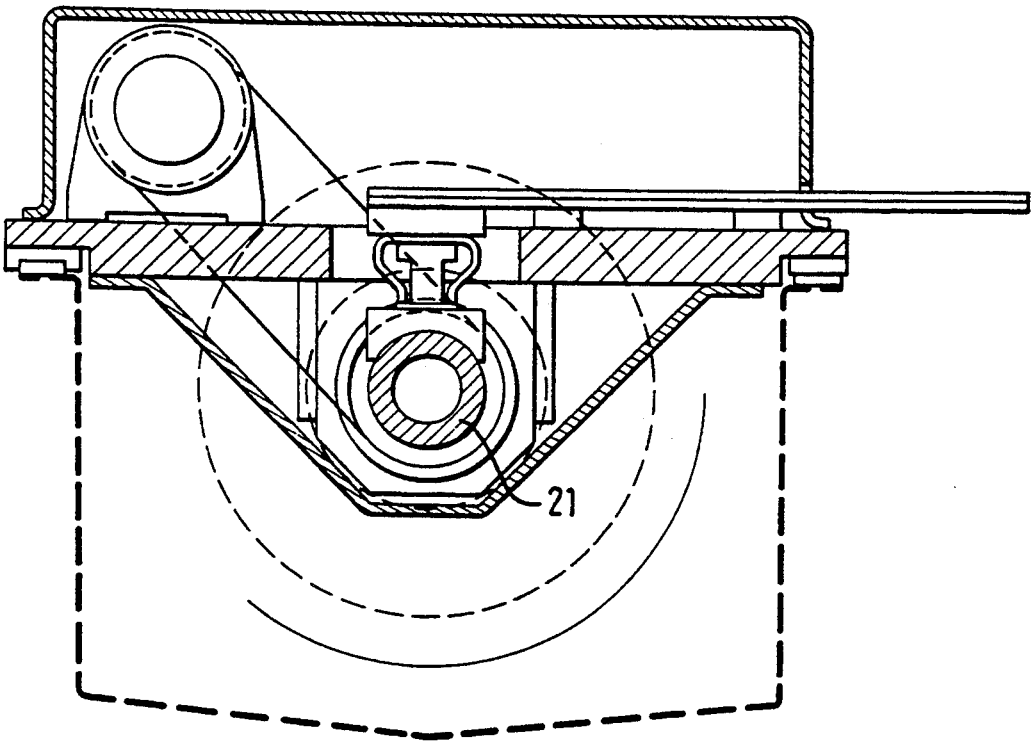
FIG. 5 illustrates an end face plan view, partly in section, of the clamping device according to FIG. 4.

As FIG. 4 shows, in this second type of a clamping device according to the invention, the interchange disc provided with different cone sleeves is dispensed with. Instead, as the sole essential adapter element for adaptation to different spindle diameters of gravure printing cylinders use is made of a hardened hollow cone 21, which is screwed in place by means of an annular flange 22, which is inserted into the wall of the casing 10 and screwed to the end face of the sleeve of the gas compression spring 7, in order to transmit high axial forces. The front region of the ram 6 of the gas compression spring 7 slides through the correspondingly adapted inside diameter of the hollow cone 21 when the printing cylinder is ejected. The angle of inclination or slope of the hollow cone 21, which preferably slopes to a point, is about 45° relative to its axis. This angle of inclination should be smaller than 60° and, depending on the application and the current density to be transmitted, could be between 30° and 45°.

The most suitable hardenable material for the hollow cone 21 is the steel alloy 100 Cr 6. Despite the high contact pressures mentioned and the extremely high current densities, this material permits long service lives, so that the replacement of the cone sleeve 21 becomes necessary only very occasionally.

While there is shown and described herein certain specific structures embodying this invention for the purpose of clarity of understanding, the same is to be considered as illustrative in character, it being understood that only preferred embodiments have been shown and described. It will be manifest to those skilled in the art that certain changes, various modifications and rearrangements of the parts may be made without departing from the spirit and scope of the underlying inventive concept and that the same is not limited to the particular forms herein shown and described except insofar as indicated in the scope of the appended claims.

The entirety of everything cited above or below is expressly incorporated herein by reference.

What is claimed is:

1. A clamping device for gravure printing cylinders which have different spindle diameters, to be processed in an electroplating plant, wherein the current is transmitted from a current supply system to outer ends of the gravure printing cylinders introduced into the plant, comprising:

a plurality of cone sleeves each having an external cone, and an outside diameter, the cone sleeves having the same outside diameter and an inside diameter adapted to a determined spindle end diameter of different gravure printing cylinders;

an intermediate sliding member mounted in each cone sleeve for axial sliding;

a movably mounted interchange holder receiving the plurality of cone sleeves, each cone sleeve is provided with an intermediate sliding member, in bores adapted to their outside diameter;

a quill cone sleeve which serves to transmit current to a spindle end by a corresponding cone sleeve and whose internal cone is adapted to a respective identical external cone of the external cone sleeves;

an ejector device mounted concentrically to the quill cone sleeve for axial displacement of a respective intermediate sliding member and the respective external cone sleeve to the released position inside the respective bore corresponding to the external cone sleeve in an interchange holder; and said interchange holder is a rotatably mounted interchange disc in which the axes of the receiving bores for the cone sleeves are disposed on a concentric circle.

2. The clamping device of claim 1, wherein each intermediate sliding member comprises at each axial end an annular shoulder projecting radially outwards for driving the appertaining cone sleeve by means of stop surfaces extending around the latter and correspondingly adapted to the respective annular shoulder.

3. The clamping device of claim 2 wherein the ejector device is a gas compression spring which is mounted inside a collector sleeve connected to the quill cone sleeve.

4. The clamping device of claim 3 further comprising a ram having a working stroke, in alignment with a respective intermediate sliding member, of the gas compression spring, wherein the working stroke of the ram is limited by an annular shoulder stop to the required engagement movement path of the intermediate sliding member and cone sleeve.

5. The clamping device of claim 2 wherein axial engagement movement of the respective cone sleeve is limited by a support fixed on the interchange holder.

6. The clamping device of claim 1 wherein the ejector device is a gas compression spring which is mounted inside a collector sleeve connected to the quill cone sleeve.

7. The clamping device of claim 6 further comprising a ram having a working stroke, in alignment with a respective intermediate sliding member, of the gas compression spring, wherein the working stroke of the ram is limited by an annular shoulder stop to the required engagement movement path of the intermediate sliding member and cone sleeve.

8. The clamping device of claim 7 wherein axial engagement movement of the respective cone sleeve is limited by a support fixed on the interchange holder.

9. The clamping device of claim 6 further comprising a ram having a working stroke, in alignment with a respective intermediate sliding member, of the gas compression spring, wherein the working stroke of the ram is limited by an annular shoulder stop to the required engagement movement path of the intermediate sliding member and cone sleeve.

10. The clamping device of claim 6 wherein axial engagement movement of the respective cone sleeve is limited by a support fixed on the interchange holder.

11. The clamping device of claim 1 wherein axial engagement movement of the respective cone sleeve is limited by a support fixed on the interchange holder.

12. The clamping device of claim 7, wherein each intermediate sliding member comprises, at each axial end, an annular shoulder projecting radially outwards for driving the respective cone sleeve by means of stop surfaces extending around the latter and correspondingly adapted to the respective annular shoulder.

13. The clamping device of claim 12 wherein the ejector device is a gas compression spring which is mounted inside a collector sleeve connected to the quill cone sleeve.

14. The clamping device of claim 13 further comprising a ram having a working stroke, in alignment with a respective intermediate sliding member, of the gas compression spring, wherein the working stroke of the ram is limited by an annular shoulder stop to the required engagement movement path of the intermediate sliding member and cone sleeve.

15. The clamping device of claim 12 wherein axial engagement movement of the respective cone sleeve is limited by a support fixed on the interchange holder.

16. The clamping device of claim 1 wherein axial engagement movement of the respective cone sleeve is limited by a support fixed on the interchange holder.

17. A clamping device for gravure printing cylinders to be processed in an electroplating plant, which have different spindle end diameters, wherein a current is transmitted from a current supply system to outer ends of the gravure printing cylinders introduced into the plant, comprising a hardened hollow cone serving as a holding and centering element for gravure printing cylinders having spindle ends and which are to be clamped at the spindle ends and which have different spindle diameters, and serving as a current transmission element between the current supply system and the spindle end of a clamped gravure printing cylinder.

18. The clamping device of claim 17, wherein the hollow cone is a pointed cone having an angle of inclination of 60° to the cone axis.

19. The clamping device of claim 17 wherein the hardened hollow cone is a hardened hollow member having a conical inner surface.

* * * * *